United States Patent [19]

Dunn et al.

[11] 4,422,172

[45] Dec. 20, 1983

[54] ELECTRODE SUPPORT MECHANISM AND METHOD

[75] Inventors: Charles S. Dunn, Pataskala; Stephen Seng, Bladensburg, both of Ohio

[73] Assignee: Owens-Corning Fiberglas Corporation, Toledo, Ohio

[21] Appl. No.: 342,870

[22] Filed: Jan. 26, 1982

[51] Int. Cl.[3] ..... H05B 7/10

[52] U.S. Cl. ..... 373/94; 373/99; 373/100; 373/101; 373/52

[58] Field of Search ..... 373/51, 50, 52, 53, 373/94, 98, 99, 100, 101, 105, 106

[56] References Cited

U.S. PATENT DOCUMENTS 3,752,896 8/1973 Zimmermann et al. ..... 373/51

FOREIGN PATENT DOCUMENTS 898528 6/1962 United Kingdom ..... 373/100

*Primary Examiner*—Roy N. Envall, Jr.

*Attorney, Agent, or Firm*—Ronald C. Hudgens; Patrick P. Pacella

[57] ABSTRACT

An electrode support mechanism and method for use in electric arc melting or smelting furnaces wherein a pair of horizontal, superimposed arms are each provided with clamping devices at their outer end for supporting and supplying electric power to a vertically disposed electrode depending into an arc furnace. The arms are each supported on a vertical support post; the upper arm is fixed to the post and the lower arm which normally carries the electrode is movable relative to the post to adjust the electrode to maintain a constant arc at the furnace. The movable arm is moved vertically by a jack screw carried by the upper arm and depending into contact with the lower arm. The clamping devices at the ends of the arms are spring-biased toward contact with the electrode, and a linking mechanism is provided to alternately release the arm clamping mechanisms from the electrode under the control of an actuating system utilizing fluid pressure actuated cylinders. The electrode is clamped to the lower clamping arm when the lower clamping arm is operating within its normal range of adjustment, but the electrode is released from the lower arm and clamped to the upper clamping arm whenever it is necessary to move the lower arm independently of the electrode to reposition the lower clamping arm within its normal range of adjustment. When the lower arm is so repositioned, the electrode is reclamped by the lower arm and released by the upper clamping arm.

15 Claims, 3 Drawing Figures

ELECTRODE SUPPORT MECHANISM AND METHOD

TECHNICAL FIELD

In the utilization of arc melting furnaces for the melting of basalt, glass batch, metals or the like, or for ore reduction, the charge to be melted is introduced in pulverant form into a furnace or crucible having a plurality of top-entering, vertically suspended electrodes. The electrodes typically are pre-baked, cylindrical carbon sections which are screwed together and which are consumed during the melting process.

The electrical current is supplied to the electrodes, typically three in number, from a transformer as the electrodes are individually suspended in the furnace or crucible for independent vertical displacement. The electrodes are individually adjusted vertically to maintain a constant voltage at each electrode-batch interface location, and the amperage varies as the resistance in the furnace changes.

The electrodes must be raised and lowered independently of one another with varying furnace operating conditions, e.g., as the resistance of the arc changes upon variations in the molten material level and the molten material temperature, as the electrode is consumed, and as cooler incoming raw materials are fed into the furnace. As a result, the electrodes are frequently moved up and down as they individually hunt for the desired balance point. Prior to the present invention, various forms of electrode supports have been proposed, but such supports have been cumbersome, expensive, non-positive electrode feeding means, which, for example, do not positively support the electrode independently of the electrode adjusting mechanism as the adjusting mechanism is reset due to electrode consumption.

DISCLOSURE OF INVENTION

The present invention now provides a new and novel electrode support mechanism and method for use in electric arc melting or smelting furnaces.

Generally, the present invention proposes the utilization of two, parallel support arms for each electrode, the arms being cantilevered from a common vertical support parallel to the electrode. Each of the arms is provided with an electrode clamping mechanism, with the electrode at all times being clampingly engaged by at least one of the arms. Both of the arms can supply electrical power to the electrode when the electrode is clamped thereto.

The lower of the arms is vertically adjustable relative to the furnace to move the electrode vertically and to support the electrode as it individually hunts for its proper balance point to maintain a constant voltage at the furnace location. The upper of the arms is fixed to the support post and its clamping mechanism is normally disengaged from the electrode as it is supported for movement on the lower arm.

Periodically, it is necessary to reposition the lower arm on the electrode, due primarily to electrode consumption. Such repositioning takes place whenever the lower arm moves to a position outside its normal range of movement necessary to maintain the substantially constant voltage delivery to the furnace. At this time, the clamping means of the upper arm is engaged with the electrode, the lower arm is unclamped from the electrode, the lower arm is elevated to a position within its normal range of movement, and the lower arm is reclamped to the electrode, after which the upper arm clamping means is opened to release the electrode for movement with the lower arm.

The lower arm is vertically moved by appropriate means, preferably by a vertical adjustment screw rotatably carried by the upper arm and depending downwardly for engagement with the lower arm.

The clamping means for the two arms are constantly spring biased toward electrode engagement and individual power means, such as fluid actuated cylinders, are utilized to alternately engage the clamping means of the two arms with the electrode. The power means is controlled by a control means to effect arm-electrode engagement and disengagement, and the operation of the two clamping means is overlapped so that the electrode is clamped at all times.

The method of the present invention involves the engagement of the electrode by a vertically movable adjustment means (the lower arm) which operates to move the electrode within a normal range of adjustment to maintain the substantially constant voltage at the furnace. This normal range of adjustment lies between upper and lower limits, preferably established by upper and lower limit switches. When the adjustment means moves to or beyond the lower limit, due primarily to electrode consumption, it is necessary to reposition the adjustment means on the electrode. Accordingly, the electrode is fixed (by engagement with the upper arm), the adjustment means is disengaged from the electrode and moved upwardly to within the normal adjustment zone and preferably against the upper limit. The repositioned adjustment means re-engages the electrode, and the electrode is released for movement with the adjustment means within the normal adjustment zone. Since both of the arms are effective to transmit electrical power to the electrode, there is no loss of power during the repositioning of the adjustment means.

BEST MODE FOR CARRYING OUT THE INVENTION

Figure 1:
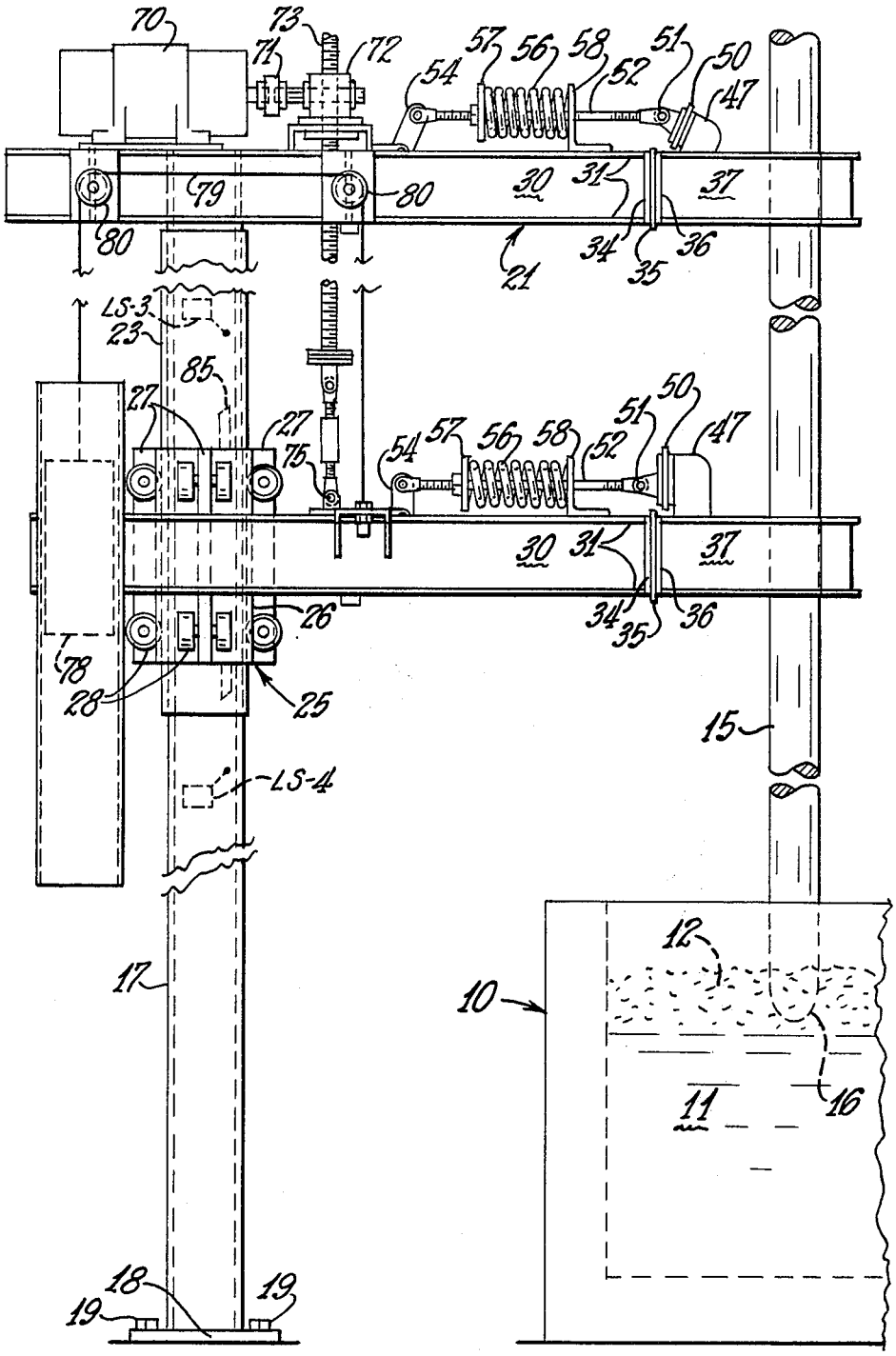
FIG. 1 is a side elevational view of an electrode carrying mechanism of the present invention which is capable of carrying out the method of the present invention.

As best shown in FIG. 1, the mechanism of the present invention is intended to be utilized in conjunction with an arc melting furnace indicated by reference numeral 10 enclosing a body of molten material 11 surmounted by a batch blanket 12 of pulverant raw material. The molten material of the body 11 may be molten basalt, molten glass, molten metal or any other molten material surmounted by the blanket 12 of raw, unmelted material. Superimposed over the furnace 10 is an electrode 15 having its lower end 16 extending into the furnace 10 and terminating within the batch blanket 12 above the level of the molten material 11. The electrode 10 preferably is of the consumable type and typically may comprise a cylindrical rod of pre-baked carbon, and preferably comprises a plurality of sections interconnected by suitable means, as by the conventional screw threads.

Positioned adjacent the furnace 10 is a vertical, upstanding post 17 secured, as by a mounting collar 18 and bolts 19 to a supporting surface to lie parallel to the vertical electrode 15. Secured to the upper extremity of the post 17 is an upper, horizontal supporting arm structure 21 fixed by appropriate means (not shown) to the post 17. Located beneath the arm 21 and in true vertical alignment therewith is a horizontal, lower arm structure 22 which is supported for movement relative to the post 17.

The support structure for the lower arm 22 includes a fixed support collar 23 enveloping the upper portion of the post to provide a guide for a lower arm carriage indicated generally at 25. This lower arm carriage 25 includes a central, open-ended sleeve 26 of a cross-section conforming to and closely embracing the fixed collar 23 and having a plurality of vertical ribs 27. Each rib 27 supports vertically spaced pairs of rollers 28 having their peripheries projecting through slots formed in the sleeve 26 and contacting the inner collar 23 in rolling contact therewith. It will be appreciated that the wheels 28 support the sleeve 26 for telescopic vertical movement upon the post collar 23, and the lower arm 22 is welded or otherwise rigidly secured to the sleeve 26 for vertical movement therewith.

Figure 2:
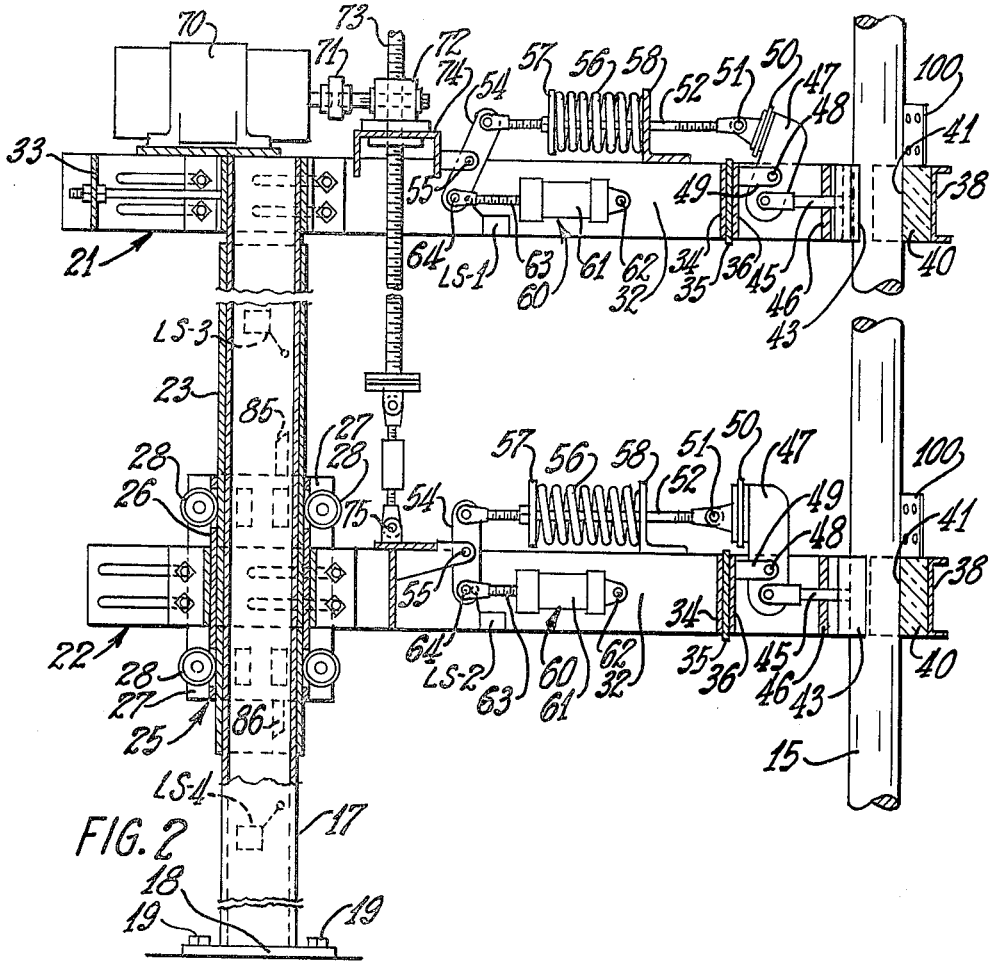
FIG. 2 is a plan view of the mechanism of FIG. 1.
Figure 3:
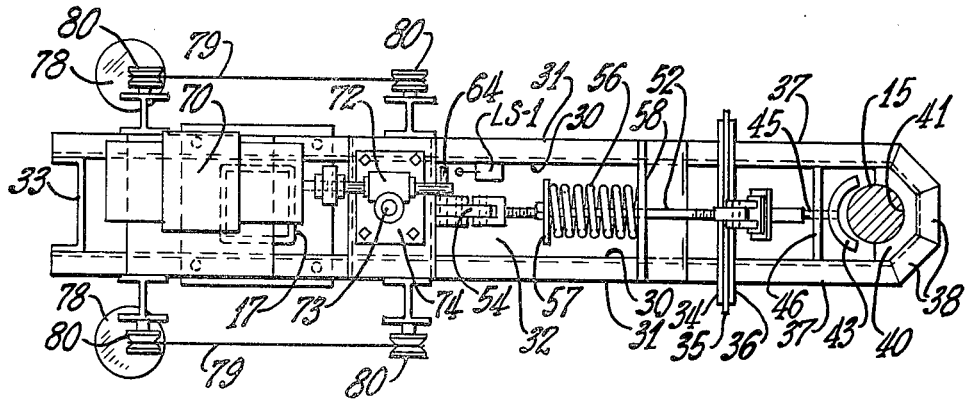
FIG. 3 is a vertical sectional view of the mechanism of FIG. 1.

The arms 21, 22 are of identical construction, and each is fabricated from two pieces of channel stock 30 having upper and lower outwardly directed flanges 31, the channels being spaced from one another to define an interior space 32 therebetween, as shown in FIG. 2. The channels 30 are retained in parallelism by appropriate cross members 33 and terminate at their forward ends in a vertical plate 34 which is laminated through a sheet of electrical insulating material to a flange 36 integral with a second pair of channels 37 similar to the channels 34 which are cut and welded to form a convex nose 38 at the free end of the arm.

Welded internally of the nose 38 to project into the open center space 32 of the arm is an electrically conductive electrode clamping pad 40 having a vertically extending, semi-cylindrical recess 41 therein for mating, sliding engagement with the electrode 15. Positioned on each clamping pad 40 is a power supply bracket 100 to which a power supply cable is attached to supply power to the electrode 15 in electrical contact therewith. A mating, arcuate, essentially semi-cylindrical, electrically conductive, movable electrode clamping element 43 is carried by an actuating stem 45 journaled in a guide plate 46 spanning the channel members 37, and this actuating stem 45 is pivotally secured to the lower end of an actuating lever 47. The actuating lever 47 is pivotally mounted by pin 48 to a bracket 48 carried by the flange 36, so that the lever 47 pivots in a vertical plane.

The free upper end of the lever 47 is connected, through an insulating assembly 50 similar to the assembly 34–36, to the free end 51 of an actuating rod 52 extending in a generally horizontal plane for attachment through pivot pin 53 to the upper end of an actuating link 54 medially pivoted as at 55, intermediate the side channels 30. A compression spring 56 is confined between a plate 57 secured to the rod 52 and a fixed bracket 58 surmounting the channels 30. The compression spring 56 normally biases the plate 57 to the left to rotate the lever 57 in a counterclockwise direction, thereby clampingly confining the electrode 15 between the arcuate clamping plate 43 and the fixed clamping pad 40.

As above explained, each of the arms 21, 22 is provided with the identical actuating mechanism including the pad 40, the clamping member 43 and the actuating mechanism 45, 47, 52, 54 and 56.

To actuate each of the above described linkages, a fluid power actuated mechanism indicated generally at 60 is utilized. This mechanism 60 includes a fluid actuated cylinder 61, preferably a pneumatic cylinder, which is secured in the space 32 between the side channels 30 by transverse mounting pin 62. The cylinder actuating rod 63 is pivoted to the lower end of the actuating link 54, as at 64. When the rod is extended, the link 54 is moved in a clockwise direction and the plate 54 compresses the spring 56 against the fixed bracket 58 and the lever 47 is pivoted in a clockwise direction to retract the semi-cylindrical electrode clamping element 43 from contact with the electrode 15. This is the condition illustrated in the upper arm 21 of FIG. 1.

When the cylinder 60 is actuated to retract the actuating rod 63, the link 54 is moved in a counterclockwise direction, the lever 47 is moved similarly in a counterclockwise direction, and the electrode clamping element 43 is moved into contact with the electrode 15 to clamp the electrode against the fixed clamping pad 40. This is the condition illustrated at the lower arm 22 in FIG. 1. The cylinders 61 may be single-acting, with fluid pressure being introduced only into the righthand side of the cylinder in order to extend the actuating rod 63. The compression of the spring 56 will normally position the link 54 and the lever 47 in their vertical positions as illustrated at the lower arm 22 in FIG. 1, and the electrode is clamped to the lower arm by the compression force of the spring 56. This is a fail-safe measure, in that any loss of fluid pressure at the cylinders 61 will ensure clamping of the electrode, so that it cannot fall by gravity into the furnace 10.

Another fail-safe measure is provided by limit switches LS-1 and LS-2 which are mounted on the arms 21 and 22, respectively. Each of these limit switches has its actuating element positioned in the path of the elongated pin 64 interconnecting the actuating rod 63 and the link 54. Either of the switches LS-1 is actuated whenever the actuating rod 63 is in its retracted position and the electrode 15 is clamped between the elements 40, 43. If neither limit switch LS-1 nor LS-2 is actuated at any time, this indicates that the electrode 15 is not clamped to either arm 21, 22 and fluid under pressure is released from both cylinders 61, so that the electrode 15 is immediately clamped to both arms 21, 22 until such time as corrective measures are taken.

The arm 22 is elevated and lowered by power means including a reversible drive motor 70 mounted on the upper arm 21 and having its drive shaft coupled, as at 71, to a right angle drive mechanism indicated generally at 72 which is effective to actuate a threaded vertical actuating shaft 73 upwardly or downwardly relative to the upper arm 21. The drive mechanism 72 is mounted on a bracket 74 on the upper arm 21. The lower end of the actuating shaft 73 is connected to the lower arm 22, as at 75. The drive mechanism, i.e., the motor 70, drive mechanism 72, shaft 73, constitute a screw jack mechanism for vertically displacing the lower arm 22 relative to the upper arm 21. A counterweight 78 is provided on either side of the arms 21, 22, each counterweight being carried by a cable or other tension means 79 trained about sheaves 80 fixed to the upper arm and secured to the lower arm 22 to counterbalance the weight of the arm 22 and the electrode 15 carried thereby.

In operation of the mechanism, as best illustrated in FIGS. 1 and 2, the electrode 15 is adjusted vertically to maintain a substantially constant arc at its lower end by vertical movement of the arm 22, the electrode being firmly clamped to the arm by the clamping element 43 biased against the electrode 15 by the lower arm actuating spring 56. The movement of the arm 22 is controlled by conventional arc control means which form no part of the present invention and which drive the reversible drive motor 70 in the appropriate direction to either raise or lower the arm 22. The motor 70 through the right angle drive mechanism 72 raises or lowers the arm through the threaded vertical actuating shaft 73, with the counterweights 78 counterbalancing the weight of the arm and the electrode 15, so that the arm 22 can move smoothly through its vertical path guided by the wheels or rollers 28 contacting the post sleeve 24. Thus, the arm 22 will move upwardly or downwardly to maintain a constant arc despite all of the variations of the process which may affect the arc, such as the rate of feed to compensate for electrode consumption, the level of the molten pool 11, the depth of the batch blanket 12, etc., so long as the arm 22 moves within its normal movement range.

Mounted at the upper extremity of the carriage 25 is an upstanding limit switch probe 85 which contact the actuating blade of a limit switch LS-3 when the arm 22 is raised to the upper limit of its normal operating range. A similar, depending limit switch actuating blade 86 depends from the carriage 25 to contact the actuating blade of a limit switch LS-4 to indicate that the arm 22 has reached the lower limit of its normal operating range.

Assuming that electrode 15 is being normally consumed and that the electrode 15 has been progressively lowered by the arm 22 to compensate for such consumption, the arm 22 will be lowered to an extent such that the limit switch LS-4 is actuated by the probe 86. At this time, it is necessary that the arm 22 be reset to the upper limit of its normal operating range, and the actuated LS-4 emits a signal to indicate that this is required. As a result of the actuation of the limit switch LS-4, the cylinder 61 of the upper arm 21 is actuated or vented to retract the cylinder rod 63, thereby moving the link 54 of the upper arm in a clockwise direction under the compressive force of the spring 56. Thus, the electrode 15 is clamped to the upper arm 21. After the limit switch LS-1 indicates clamping of the electrode to the upper arm, the cylinder 60 of the lower arm 22 is actuated to extend the rod 63 to compress the associated spring 50 and retract the clamping member 43 from contact with the electrode 15. As a result, the upper lever 47 and the lower lever 47 are displaced to reverse their positions of FIGS. 1 and 2 to retract the lower clamping element 43 (thereby releasing the electrode from the lower arm) and advancing the upper clamping element 43 (thereby clamping the electrode to the upper arm).

Once the lower arm 22 releases the electrode 15, the motor 80 is actuated to fully retract the arm 22 upwardly until such time as the probe 95 actuates the limit switch LS-1. Upon actuation of the limit switch LS-1, the cylinders 61 are actuated to their positions of FIGS. 1 and 2, and the electrode 15 is released from the upper arm 21 and is clamped to the lower arm 22 by the positioning of the clamping elements 43 as illustrated in FIG. 1.

The normal operation of the apparatus is then resumed with the arm 22 being vertically actuated to maintain the constant arc at the lower tip of the electrode and to compensate for consumption of the electrode 15.

In the device as actually contructed, the actuation of the motor 80 to raise and lower the lower arm 22 and the actuation of the cylinder 70 to control the releasing and clamping of the electrode to one or the other of the arms 21, 22 is carried out in a microprocessor by well-known, conventional type, and this microprocessor forms no part of the present invention. The microprocessor is simply programmed to carry out the operation of the device as above explained.

We claim:

1. An electrode support for an arc-type furnace, comprising a vertical support post, a first support arm fixed to the post and cantilevered therefrom with its free end carrying electrode-engaging clamp means, a second support arm, means supporting said second arm on said post for vertical displacement relative thereto, said second arm being cantilevered from said support means with its free end carrying electrode-engaging clamp means vertically aligned with the clamp means of the first arm, and screw jack means interconnecting said arms for vertically displacing said second arm relative to said first arm.

2. An electrode support for an arc-type furnace, comprising a vertical support post, a first support arm fixed to the post and cantilevered therefrom, a second support arm vertically movable along the post and cantilevered therefrom, each arm having clamping means at its free end and the clamping means being aligned for engagement with vertically spaced portions of an electrode extending therebetween, means for vertically adjusting said second arm along the post relative to the fixed first arm, and means for alternately engaging said clamping means with said electrode, the electrode being supported by the clamping means of the first arm when the clamping means of the second arm is disengaged therefrom, and vice versa.

3. An electrode support for an arc-type furnace comprising a vertical support post, a pair of horizontal arms cantilevered from said post, one of said arms being fixed to the post and the other of said arms being movable vertically relative to the post, the arms each having an electrode-engaging clamp at its free end and the two clamps being vertically aligned, means for engaging and releasing the clamps in sequence, means for moving said other of said arms in a first mode in which its clamp is engaged with the electrode to adjust the electrode relative to the furnace while the one of said arms has its clamp released, and means for moving said other of said arms in a second mode in which its clamp is released to adjust the other arm relative to the electrode while the clamp of the one arm is engaged to retain the electrode fixed relative to the furnace.

4. A support for holding and adjusting a consumable electrode relative to an arc-type furnace comprising a vertical support post, a pair of horizontal arms cantilevered from said post including a first arm fixed to the post and a second arm movable vertically along the post, an electrode-engaging clamp at the free end of each arm, means for opening and closing each clamp on the electrode in sequence with one clamp being closed when the other clamp is open, means for vertically adjusting the second arm along said post within a normal range of electrode adjusting movement while the second arm clamp is closed and the first arm clamp is open, and means responsive in sequence to movement of said second arm beyond said normal range of movement (1) to close the first arm clamp, (2) to open the second arm clamp, (3) to move the second arm along the post to a position within said normal range. (4) to close the second arm clamp on the electrode, and (5) to open the first arm clamp.

5. An electrode support for an arc-type furnace comprising a vertical support structure, a first support arm fixed to the support structure, a second support arm vertically movable along the support structure, electrode clamping means on each arm, the electrode clamping means of the two arms being aligned for engagement with vertically extending portions of an electrode extending therebetween, biasing means constantly urging each of said clamping means toward engagement with the electrode, actuatable power means for urging each of said clamping means away from said electrode when actuated, and means responsive to actuation of said power means on one of said arms preventing actuation of the power means on the other of said arms to ensure that the electrode is always clampingly engaged by the biasing means urging the clamping means of the other arm into engagement with the electrode.

6. An electrode support for an arc-type furnace comprising a vertical support structure, a first support arm fixed to the support structure, a second support arm vertically movable relative to the support structure, each arm having clamping means thereon, said clamping means being aligned for engagement with vertically spaced portions of an electrode extending therebetween, said second arm being vertically movable within a normal range of movement to adjust the electrode relative to the furnace, means responsive to movement of said movable arm beyond its normal range of movement to sequentially (1) clamp the electrode to the fixed arm and (2) to unclamp the electrode from the movable arm, and means responsive to movement of said movable arm to a position within its normal range of movement (1) to clamp the electrode to the movable arm and (2) to unclamp the electrode from the fixed arm, so that the electrode is again movable relative to the furnace with said movable arm.

7. An electrode support for an arc-type furnace comprising a vertical support post, a first support arm fixed to the post and cantilevered therefrom, a second support arm vertically movable along the post and cantilevered therefrom, each arm having clamping means at its free end and the clamping means being aligned for engagement with vertically spaced portions of an electrode extending therebetween, means for vertically adjusting said second arm along the post relative to the fixed first arm, and means for alternately engaging said clamping means with said electrode, the electrode being supported by the clamping means of the first arm when the clamping means of the second arm is disengaged therefrom, and vice versa, said last-named means including a spring biasing of each clamp means into engagement with the electrode and power means actuatable to overcome the bias of said spring.

8. An electrode support for an arc-type furnace, comprising a vertical support structure, a first support arm fixed to the support structure, a second support arm, means supporting said second arm on the support structure for vertical displacement relative thereto, electrodeengaging clamp means on each of said first and second arms, the clamping means of the second arm being vertically aligned with the clamp means of the first arm to receive an electrode, screw jack means interconnecting said arms for vertical displacement of said second arm relative to said first arm, and control means normally engaging the clamp means of the second arm only with said electrode, so that the electrode is displaced vertically with said second arm.

9. An electrode support for an arc-type furnace comprising a vertical support structure, a pair of horizontal arms carried by said structure, one of said arms being fixed to the structure and the other of said arms being movable vertically relative to the structure, an electrode-engaging clamp on each arm, the two clamps being vertically aligned for engagement with spaced portions of a vertical electrode, means for engaging and releasing the clamps in sequence, means for moving said other of said arms in a first mode and in a second mode, means for engaging the other arm clamp with the electrode as the other arm moves in its first mode to adjust the electrode relative to the furnace while the one arm clamp is released, means for disengaging the other arm clamp from the electrode as the other arm moves in its second mode to adjust said other arm relative to the electrode, and means for engaging the clamp of the one arm with the electrode prior to and during movement of the other arm in its second mode to retain the electrode fixed relative to the furnace.

10. A support for holding and adjusting a consumable electrode relative to an arc-type furnace comprising a vertical support structure, a pair of horizontal arms including a first arm fixed to the structure and a second arm movable vertically relative to said structure, an electrode-engaging clamp on each arm and the clamps being vertically aligned, means connecting each clamp to a source of electrical power for the electrode, means for electrically isolating each clamp from the associated arm, means for opening and closing each clamp on the electrode in sequence with one clamp being closed when the other clamp is open, means for vertically adjusting the second arm within a normal range of electrode adjusting movement while the second arm clamp is closed and the first arm clamp is open, and means responsive in sequence to movement of said second arm beyond said normal range of movement (1) to close the first arm clamp, (2) to open the second arm clamp, (3) to move the second arm to a position within said normal range, (4) to close the second arm clamp on the electrode, and (5) to open the first arm clamp, the electrode being supplied with electrical power and being supported solely by the first arm at all times when the second arm clamp is open.

11. A method of holding and adjusting a vertically disposed consumable electrode for an arc-type furnace to maintain a substantially constant current flow through the electrode, comprising the steps of:

(1) engaging the electrode intermediate its length by a vertically displaceable support arm with the electrode depending from the arm into the furnace, the electrode being connected by the arm to a source of electricity;

(2) vertically jointly displacing said arm and said electrode in either vertical direction to maintain said substantial constant current flow despite fluctuations in the furnace operating condition and despite electrode consumption;

(3) periodically vertically upwardly moving the arm relative to said electrode to compensate for electrode consumption and fluctuating operating conditions without interrupting current flow through the electrode by the steps of:

(a) securing the electrode above the location of arm-electrode engagement to a clamping mechanism which is vertically fixed, the clamping mechanism connecting the electrode to a source of electricity, (b) disengaging the arm from the electrode secured to said clamping mechanism, (c) upwardly displacing the arm only, (d) re-engaging the arm with the electrode, and (e) releasing the clamping mechanism from the electrode; and (4) resuming the performance of step (2).

12. A method of holding and adjusting a vertically disposed consumable electrode for an arc-type furnace to maintain a substantially constant current flow through the electrode, comprising the steps of:

(1) normally adjusting an electrode vertically to maintain said current flow by engaging the electrode intermediate its length with a vertically displaceable clamp connected to a source of electrical power for the electrode, the clamp being movable vertically both up and down in a current maintenance mode between upper and lower limits;

(2) when said clamp is displaced in its current maintenance mode to a position which is below the said lower limit, moving the clamp in a repositioning mode to reposition the clamp on the electrode by the steps of:

(a) securing the electrode in a fixed position while continuing to supply the electrode with electrical power, (b) disengaging the clamp from the electrode, (c) moving the clamp upwardly relative to the electrode to the upper limit of the first mode, (d) re-engaging the clamp with the electrode, and (e) releasing the electrode for travel with the clamp while receiving electric power from the clamp; and (3) resuming the performance of step (1) to move the clamp in its current maintenance mode.

13. A method of holding and adjusting a vertically disposed consumable electrode for an arc-type furnace to maintain a substantially constant current flow through the electrode, comprising the steps of:

(1) normally adjusting an electrode vertically to maintain said current flow by engaging the electrode intermediate its length with a vertically displaceable cantilevered adjustment arm connecting the electrode with a source of electrical power, the adjustment arm being movable both up and down in a first mode above a lower limit;

(2) moving the adjustment arm in a second mode to reposition the arm on the electrode whenever the adjustment arm attains said lower limit by the steps of:

(a) retaining the electrode in a fixed position independently of said adjustment arm while continuously supplying current to the electrode, (b) disengaging the adjustment arm from the electrode, (c) elevating the adjustment arm relative to the electrode, (d) re-engaging the elevated adjustment arm with the electrode, and (e) releasing the electrode for travel with the adjustment arm and to receive electric power only from the arm; and (3) resuming the performance of step (1) to move the adjustment arm in its first mode.

14. A method of holding and adjusting a vertically disposed consumable electrode for an arc-type furnace to maintain a substantially constant current flow through the electrode, comprising the steps of:

(1) engaging the electrode with a vertically movable cantilevered arm so that the electrode depends from the arm into the furnace, while supplying current to the electrode from the arm;

(2) jointly vertically moving the arm and the electrode in both vertical directions within a normal range of arm movement to maintain said current flow and to compensate for electrode consumption;

(3) whenever the arm is positioned outside said normal range of movement, sequentially performing the steps of:

(a) securing the electrode to a fixed clamp located outside the normal range of movement of said arm while supplying current to the electrode through the fixed clamp, (b) releasing the electrode from the arm, (c) moving the arm independently of the electrode to a position within the normal range of movement of the arm, (d) re-engaging the electrode with the arm, and (e) releasing the electrode from the fixed clamp;

(4) resuming the performance of step (2) above after the performance of step (3).

15. An electrode support for holding and adjusting a vertical electrode for an arc-type furnace, comprising a support element adjacent the furnace, a vertically adjustable arm carried by said support element, means for vertically adjusting said arm, a first clamp on said arm engageable with a medial portion of an electrode depending into said furnace, electrical power means for supplying current to the electrode through said first clamp, the arm being vertically adjustable in a normal range of movement within which the electrode is moved both up and down to maintain a substantially constant current flow therethrough, a second clamp fixedly secured to said support element in vertical alignment with said first clamp and also engageable with said electrode, the second clamp being located outside said normal range of movement of said arm, and means responsive to vertical adjustment of said arm outside its normal range of movement to engage the second clamp to the electrode, to disengage the first clamp, to shift the arm to a position back within its normal range of movement, to re-engage the first clamp and to disengage the second clamp.

* * * * *